US011391471B2

(12) United States Patent
Qin

(10) Patent No.: US 11,391,471 B2
(45) Date of Patent: Jul. 19, 2022

(54) AIR CONDITIONER INDOOR UNIT AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Qiang Qin, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 435 days.

(21) Appl. No.: 16/676,677

(22) Filed: Nov. 7, 2019

(65) Prior Publication Data

US 2020/0309389 A1 Oct. 1, 2020

Related U.S. Application Data

(63) Continuation of application No. PCT/CN2019/109133, filed on Sep. 29, 2019.

(30) Foreign Application Priority Data

Mar. 29, 2019 (CN) ..... 201910256047.7
Mar. 29, 2019 (CN) ..... 201920435043.0

(51) Int. Cl.
*F24F 1/0011* (2019.01)
*F24F 1/0025* (2019.01)
(Continued)

(52) U.S. Cl.
CPC ..... *F24F 1/0011* (2013.01); *F24F 1/0025* (2013.01); *F24F 1/0057* (2019.02);
(Continued)

(58) Field of Classification Search
CPC ..... F24F 1/0011; F24F 1/0025; F24F 1/0057; F24F 1/0063; F24F 13/0254; F24F 13/20; F24F 13/32
See application file for complete search history.

(56) References Cited

U.S. PATENT DOCUMENTS

2017/0138613 A1* 5/2017 Bai ..... F24F 1/0057
2018/0017282 A1* 1/2018 Liu ..... F24F 1/0057

FOREIGN PATENT DOCUMENTS

CN 106705236 A 5/2017
CN 106907782 A 6/2017
(Continued)

OTHER PUBLICATIONS

World Intellectual Property Organization (WIPO) International Search Report for PCT/CN2019/109133 dated Sep. 29, 2019 23 Pages(translation included).

(Continued)

*Primary Examiner* — Emmanuel E Duke
(74) *Attorney, Agent, or Firm* — Anova Law Group PLLC

(57) ABSTRACT

An air conditioner indoor unit includes a housing and an air duct structure. The housing has an accommodating cavity with an opening and includes an elastic plate arranged at the opening. The air duct structure is detachably disposed in the accommodating cavity and is configured to abut against and deform the elastic plate when passing through the opening.

20 Claims, 6 Drawing Sheets

(51) Int. Cl.

| | |
|---|---|
| ***F24F 1/0057*** | (2019.01) |
| ***F24F 13/20*** | (2006.01) |
| ***F24F 13/32*** | (2006.01) |
| ***F24F 13/02*** | (2006.01) |
| ***F24F 1/0063*** | (2019.01) |

(52) U.S. Cl.
CPC ..... *F24F 1/0063* (2019.02); *F24F 13/0254* (2013.01); *F24F 13/20* (2013.01); *F24F 13/32* (2013.01)

(56) References Cited

FOREIGN PATENT DOCUMENTS

| | | | |
|---|---|---|---|
| CN | 107062397 | A | 8/2017 |
| CN | 109882937 | A | 6/2019 |
| EP | 2980503 | A1 | 2/2016 |
| JP | H09243162 | A | 9/1997 |
| JP | 2006214678 | A | 8/2006 |
| WO | 2016154953 | A1 | 10/2016 |
| WO | 2016154954 | A1 | 10/2016 |
| WO | 2018133207 | A1 | 7/2018 |

OTHER PUBLICATIONS

World Intellectual Property Organization (WIPO) International Search Report and Written Opinion for PCT/CN2019/109133 with translation dated Dec. 30, 2019 23 Pages.

Japan Patent Office (JPO) Notice of Reasons for Refusal for JP Application No. 2019-561893 dated Aug. 3, 2021 8 Pages (Translation Included).

Korean Intellectual Property Office (KIPO) Notification of Reason for Refusal for KR Application No. 10-2019-7033715 dated Aug. 20, 2021 13 Pages (Translation Included ).

The European Patent Office (EPO) Extended Search Report for EP Application No. 19795075.1, dated May 19, 2020 8 Pages.

* cited by examiner

AIR CONDITIONER INDOOR UNIT AND AIR CONDITIONER

CROSS-REFERENCE TO RELATED APPLICATIONS

This application is a continuation of International Application No. PCT/CN2019/109133, filed Sep. 29, 2019, which claims priority to Chinese Patent Application Nos. 201910256047.7 and 201920435043.0, both entitled "Air conditioner indoor unit and air conditioner" and filed Mar. 29, 2019, the entire contents of all of which are incorporated herein by reference.

TECHNICAL FIELD

The present disclosure relates to the technical field of air conditioners and, in particular, to an air conditioner indoor unit, and air conditioner having the indoor unit.

BACKGROUND

In a wall-mounted air conditioner indoor unit in related arts, the air duct structure is typically designed as a detachable structure, to facilitate cleaning and maintenance. However, as the air duct structure takes a large space, the overall thickness of the air conditioner indoor unit is relatively large, in order to ensure that the air duct structure can enter and exist without being scratched.

The aforementioned is for assisting in understanding the technical solution of the present disclosure, and does not constitute an admission that the aforementioned is prior art.

SUMMARY

The main purpose of the present disclosure is to provide an air conditioner indoor unit and an air conditioner, aiming at effectively decreasing the overall thickness of the air conditioner indoor unit and in the meantime ensuring that the air duct structure is freely pulled out or pushed in.

In order to achieve the above purpose, the air conditioner indoor unit provided by the present disclosure includes an accommodation cavity, a chassis and an elastic plate, in which the chassis is positioned in an up-down direction, and the elastic plate is connected with a lower edge of the chassis and extends downwards; the air duct structure is detachably arranged in the accommodation cavity and elastically abutted against the elastic plate when being pulled out or pushed in.

In at least one embodiment of the present disclosure, the air conditioner indoor unit further includes a heat exchanger disposed in the accommodation cavity and a pipe assembly connected with the heat exchanger; the elastic plate includes a connection member and a partitioning member, in which the connection member is connected to the lower edge of the chassis at a side away from the partitioning member; the partitioning member is positioned between the pipe assembly and the air duct structure; the air duct structure is elastically abutted against the connection member or the partitioning member when being pulled out or pushed in.

In at least one embodiment of the present disclosure, the partitioning member is bent toward the pipe assembly.

In at least one embodiment of the present disclosure, the partitioning member includes a receiving cavity facing towards the pipe assembly for receiving the pipe assembly.

In at least one embodiment of the present disclosure, an inner wall of the receiving cavity has an arc shape.

In at least one embodiment of the present disclosure, the partitioning member includes an installation notch at a side away from the connection member, to expose the pipe joint of the pipe assembly.

In at least one embodiment of the present disclosure, the elastic plate and the chassis are of an integral structure; and/or elastic plate and the chassis are connected with a smooth joint.

In at least one embodiment of the present disclosure, the housing includes a plurality of elastic plates disposed at intervals along a length direction of the chassis; the air duct structure is elastically abutted against at least one of the elastic plates when being pulled out or pushed in; or, the housing includes one elastic plate disposed at middle of the chassis in a length direction; the air duct structure is elastically abutted against the elastic plates when being pulled out or pushed in; or, the housing includes two elastic plates disposed at two ends of the chassis in a length direction; the air duct structure is elastically abutted against at least one of the elastic plates when being pulled out or pushed in.

In at least one embodiment of the present disclosure, the housing further includes a face frame and a lower panel, in which the face frame is connected to the upper edge of the chassis; and the face frame, the chassis and the elastic plate are enclosed to form the accommodation cavity; the lower panel is detachably mounted on the face frame and includes an air outlet; and/or, a wall-mount plate is disposed at a back of the housing, the wall-mount plate includes a hanging fastener at a side away from the housing.

The present disclosure also provides an air conditioner, which includes an indoor unit and an outdoor unit connected with the indoor unit; the air conditioner indoor unit includes an accommodation cavity, a chassis and an elastic plate, in which the chassis is positioned in an up-down direction, and the elastic plate is connected with a lower edge of the chassis and extends downwards; the air duct structure is detachably arranged in the accommodation cavity and elastically abutted against the elastic plate when being pulled out or pushed in.

According to the technical solution of the present disclosure, the lower edge of the chassis is provided with an elastic plate, when the air duct structure is pulled or pushed in, the outer wall surface of the air duct structure is elastically abutted against the surface of the elastic plate. As such, the elastic plate is deformed and swung in a direction away from the air duct structure, allowing a space for the air duct structure to pass through; when the air duct structure is pulled out or installed in place, the elastic plate automatically restores to its original state. As the elastic plate allows a space for the air duct structure to pass through when the air duct structure is pulled or pushed in, no large space is needed for free passing of the air duct structure, and therefore unnecessary thickening of the whole machine body of the air conditioner indoor unit is avoided. The appearance in thickness of the indoor unit body of air conditioner is ensured.

BRIEF DESCRIPTION OF THE DRAWINGS

In order to explain the embodiment of the present disclosure more clearly, the following will briefly introduce the drawings used in the description of the embodiments. Obviously, the drawings in the following description are only some embodiments of the present disclosure. For those ordinary skill in the art, other drawings can be obtained according to the structure shown in these drawings without any creative effort.

FIG. 4 is a schematic cross-sectional view of the air conditioner indoor unit when the air duct structure is pulled out or pushed in.

DESCRIPTION OF REFERENCE NUMERALS

Figure 1:
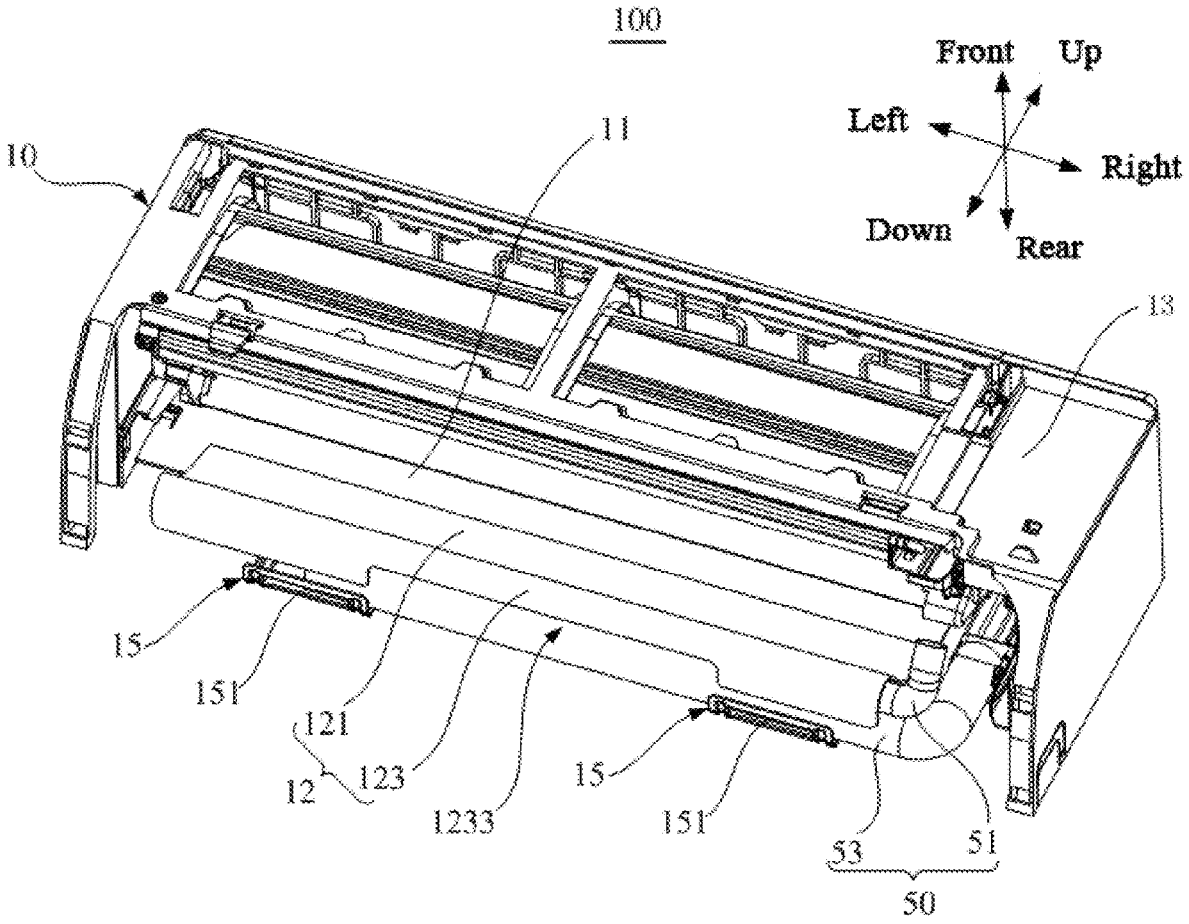
FIG. 1 is a schematic structural view of an air conditioner indoor unit with the air duct structure detached according to an embodiment of the present disclosure.

| Reference Numeral | Name | Reference Numeral | Name |
|---|---|---|---|
| 100 | Air conditioner indoor unit | 15 | Wall-mount plate |
| 10 | Housing | 151 | Hanging fastener |
| 10a | Accommodation cavity | 20 | Air duct structure |
| 11 | Chassis | 20a | Air inlet side |
| 12 | Elastic plate | 20b | Air outlet side |
| 121 | Connection member | 30 | Heat exchanger |
| 123 | Partitioning member | 50 | Pipe assembly |
| 1231 | Receiving cavity | 51 | Drain pipe |
| 1233 | Installation notch | 53 | Refrigerant input/output pipe |
| 13 | Face frame | 531 | Pipe body |
| 14 | Lower panel | 533 | Insulation layer |
| 141 | Air outlet | | |

DETAILED DESCRIPTION OF THE EMBODIMENTS

In the following, the technical solution in the embodiments of the present disclosure will be described with reference to the drawings in the embodiment of the present disclosure. Obviously, the described embodiments are only some of the embodiments of the present disclosure, not all of the embodiments. Based on the embodiments described in the present disclosure, all other embodiments perceived by those ordinary skills in the art without creative effort should fall within the scope of the present disclosure.

It should be noted that all directional indicators (such as upper, lower, left, right, front, rear, etc.) in the embodiment of the present disclosure are only used to explain the relative positional relationship, movement, etc., between various components under a certain specific attitude (as shown in the drawings). If the specific attitude changes, the directional indicator will also change accordingly.

In the present disclosure, the terms "connected" and "fixed," etc., should be understood in a broad sense, unless otherwise specified and defined. For example, "fixed" can be a fixed connection, a detachable connection, or forming an integral part; can be a mechanical connection or an electrical connection; can be a direct connection or an indirect connection through an intermediate medium; and can be the communication between interior of two elements or the interaction between two elements, unless otherwise in some embodiments specified. For those ordinary skilled in the art, the specific meanings of the aforementioned terms in the present disclosure can be understood according to practical conditions.

In addition, the technical solutions of various embodiments may be combined with each other as long as they do not conflict with each other.

The present disclosure provides an air conditioner indoor unit 100.

Figure 2:
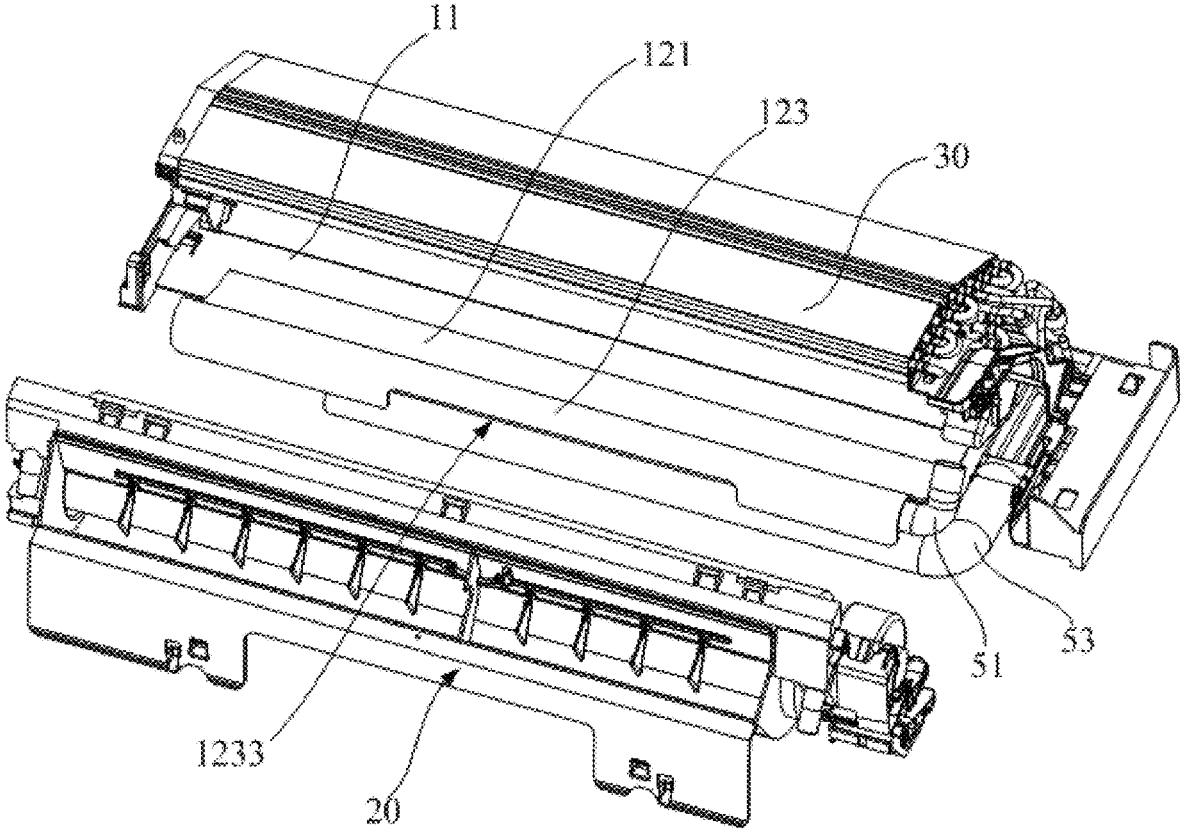
FIG. 2 is a schematic partially exploded view of an air conditioner indoor unit.
Figure 3:
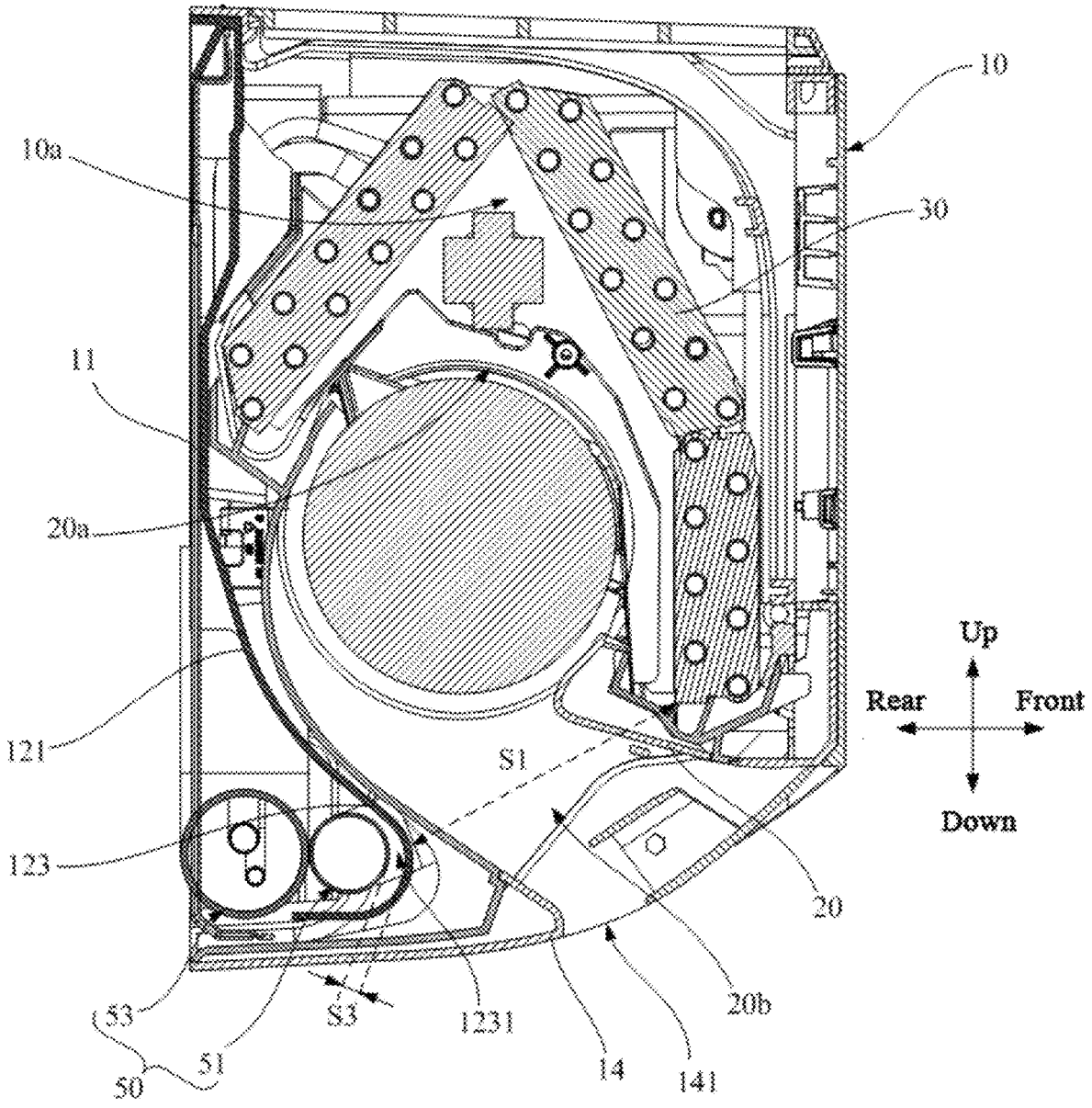
FIG. 3 is a schematic cross-sectional view of the air conditioner indoor unit with the air duct structure mounted in place.

Referring to FIGS. 1 to 3, in at least one embodiment of the air conditioner indoor unit 100 of the present disclosure, the air conditioner indoor unit 100 includes a housing 10 and an air duct structure 20. The housing 10 has an accommodation cavity 10*a* therein. The housing 10 includes a chassis 11 and an elastic plate 12 positioned in an up-down direction, and the elastic plate 12 is connected to a lower edge of the chassis 11 and extending downward. The air duct structure 20 is removably arranged in the accommodation cavity 10*a*, and is elastically abutted against the elastic plate 12 when being pulled or pushed in.

In some embodiments, the elastic plate 12 can be made of acrylonitrile-butadiene-styrene plastic or impact-resistant polystyrene. Acrylonitrile-butadiene-styrene plastic and impact-resistant polystyrene both have good elasticity, and the elastic plate 12 made of such materials has good elasticity, allowing the air duct structure 20 to be smoothly pulled or pushed in. The elastic plate 12 is connected to the lower edge of the chassis 11 and extends downward. The connection between the elastic plate 12 and the chassis 11 can be a snap connection or a screw connection, or the elastic plate 12 and the chassis 11 can be an integral structure. The elastic plate 12 may be square, trapezoidal, or another reasonable shape, which is not limited here. The air duct structure 20 is detachably installed in the accommodation cavity 10*a* and is located at the lower part of the accommodation cavity 10*a*. The outer contour of the cross section of the air duct structure 20 in the front-rear direction is approximately arc-shaped, which enables the air duct structure 20 to be disassembled and assembled smoothly. When the air duct structure 20 is pulled or pushed in, the outer wall of the air duct structure 20 would be elastically abutted against the surface of the elastic plate 12. As such, the elastic plate 12 can be deformed and swung in a direction away from the air duct structure 20 to allow a space for the air duct structure 20 to pass through. When the air duct structure 20 is pulled out or installed in place, the elastic plate 12 automatically restores to its original state due to its own elasticity.

Therefore, it can be understood that, according to the technical solution of the present disclosure, the lower edge of the chassis 11 is provided with an elastic plate 12, and when the air duct structure 20 is pulled or pushed in, the outer wall surface of the air duct structure 20 is elastically abutted against the surface of the elastic plate 12. As such, the elastic plate 12 is deformed and swung in a direction away from the air duct structure 20, allowing a space for the air duct structure 20 to pass through; after the air duct structure 20 is pulled out or installed in place, the elastic plate 12 automatically restores to its original state. As the elastic plate 12 allows a space for the air duct structure 20 to pass through when the air duct structure 20 is pulled or pushed in, no large space is needed for free passing of the air duct structure 20, and therefore unnecessary thickening of the whole machine body of the air conditioner indoor unit 100 is avoided. The body appearance in thickness of the air conditioner indoor unit 100 is ensured.

In at least one embodiment of the present disclosure, air conditioner indoor unit 100 further includes a heat exchanger 30 disposed in the accommodation cavity 10*a* and a pipe assembly 50 connected with the heat exchanger 30; the elastic plate 12 includes a connection member 121 and a partitioning member 123 connected with each other, a side of the connection member 121 away from the partitioning member 123 is connected to the lower edge of the chassis 11; the partitioning member 123 is positioned between the pipe assembly 50 and the air duct structure 20; and the air duct structure 20 is elastically abutted against the connection member 121 or the partitioning member 123 when being pulled out or pushed in.

In some embodiments, the heat exchanger 30 is installed in the upper part of the accommodation cavity 10*a*, and faces the air inlet side 20*a* of the air duct structure 20, and the air inlet side 20*a* is connected with the heat exchanger 30, so that the heat exchanged air may flow into the air duct structure 20 from the air inlet side 20*a*, and then flow out from the air outlet 141 of the air duct structure 20. The pipe assembly 50 includes a refrigerant input/output pipe 53 and a drain pipe 51. The refrigerant input/output pipe 53 is connected to the heat exchanger, and is configured to supply refrigerant to the heat exchanger 30. The elastic plate 12 includes a connection member 121 and a partitioning member 123 connected with each other. The connection between the connection member 121 and the partitioning member 123 can be a snap connection or a screw connection, or the connection member 121 and the partitioning member 123 can be an integral structure. The side of the connection member 121 facing away from the partitioning member 123 is connected to the lower edge of the chassis 11 and extends downward, and the connection member 121 is slightly inclined toward the air duct structure 20. The partitioning member 123 is connected to the lower edge of the connection member 121 and extends downward, and the partitioning member 123 is located between the pipe assembly 50 and the air duct structure 20, to protect the pipe assembly 50 from being pressed or scratched when the air duct structure is abutted against the elastic plate 12 when being pulled or pushed in can be avoided. When the air duct structure 20 is pulled or pushed in, the air duct structure 20 is elastically abutted against the connection member 121 and/or the partitioning member 123 of the elastic plate 12, so that the connection member 121 and the partitioning member 123 are deformed and swung toward the pipe assembly 50, to allow a space for the air duct structure 20 to pass through.

The refrigerant input/output pipe 53 includes a pipe body 531 and an insulation layer 533 wrapped outside the pipe body 531. The insulation layer 533 can protect and insulate the refrigerant pipe body 531, effectively preventing the refrigerant input/output pipe 53 from being scratched due to the elastic press of the pipe assembly 50 by the elastic plate 12 when the air duct structure 20 is pulled out or pushed in.

Figure 4:
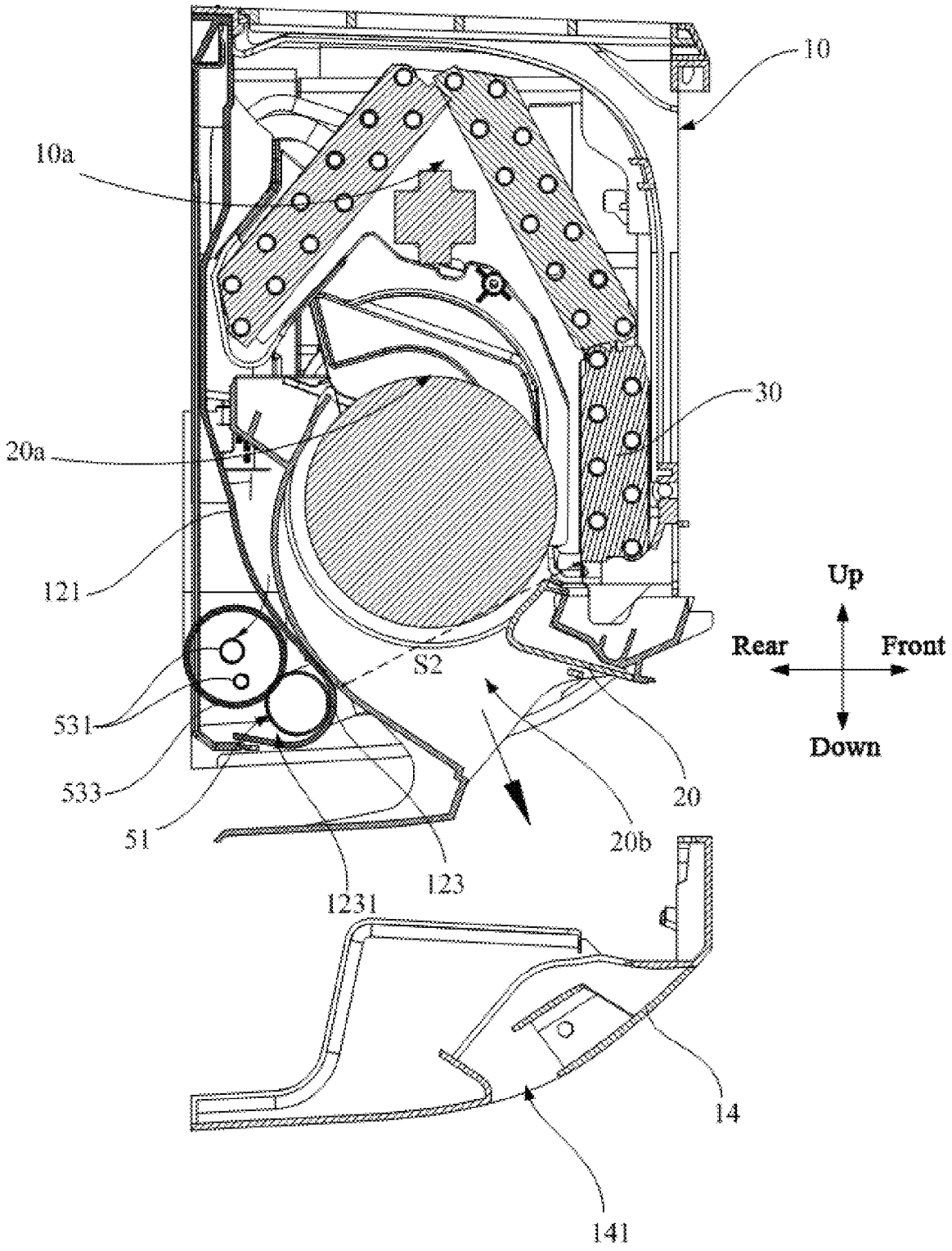

Referring to FIGS. 3 and 4, in the front-rear direction of the air conditioner indoor unit 100, the minimum distance between the elastic plate 12 and the heat exchanger 30 is denoted as S1, the minimum distance between the outer surface of the pipe in the pipe assembly 50 and the plate surface of the elastic plate 12 is denoted as S3, and the maximum diameter of the outer contour of the air duct structure 20 is denoted as S2. To ensure that the elastic deformation of the elastic plate 12 can make space for the air duct structure 20 to pass through, the following conditions need to be met: $S1<S2$ and $S1+S3\geq S2$.

Further, the partitioning member 123 is bent toward the pipe assembly 50. Since the partitioning member 123 is deformed and swung toward the pipe assembly 50 when the air duct structure 20 is pulled or pushed in, bending the partitioning member 123 toward the pipe assembly 50 can ensure the strength of the deformation process of the elastic plate 12, and can further reduce the distance between the pipe assembly 50 and the heat exchanger 30 and meanwhile ensure the passing of the air duct structure 20. The overall thickness of the air conditioner indoor unit 100 is thereby further reduced. In the meanwhile, bending the partitioning member 123 toward the pipe assembly 50 can also guide the pulling or pushing operation of the air duct structure 20, thus enabling the pulling or pushing operation of the air duct structure 20 to be more smoothly.

Further, referring to FIG. 3 again, the partitioning member 123 is formed with a receiving cavity 1231 toward the pipe assembly 50 for receiving the pipe assembly 50.

In some embodiments, the partitioning member 123 is recessed approximately toward the air duct structure 20 to form a receiving cavity 1231, which is disposed corresponding to the pipe assembly 50. When the air duct structure 20 is pulled out or pushed in, the partitioning member 123 is bent toward the pipe assembly 50, so that the pipe assembly 50 is just received in the receiving cavity 1231, and part of the outer wall surface of the pipe in the pipe assembly 50 touches the cavity wall of the receiving cavity 1231. As such, the distance between the pipe assembly 50 and the heat exchanger 30 can be further reduced to ensure the passing of the air duct structure 20, thereby further reducing the overall thickness of air conditioner indoor unit 100 and ensuring the appearance in the body thickness of the air conditioner indoor unit 100.

Further, the inner wall of the accommodation cavity 1231 is arranged itself in an arc shape. As the refrigerant input/output pipe 53 or the drain pipe 51 in the pipe assembly 50 are both circular pipe structures, the inner wall of the accommodation cavity 1231 is provided with an arc-shaped structure correspondingly. When the air duct structure 20 is pulled or pushed in, the partitioning member 123 is bent toward the pipe assembly 50. And the outer wall of the pipe in the pipe assembly 50 can be well touched to the cavity wall of the accommodation cavity 1231, which can further reduce the overall thickness of the air conditioner indoor unit 100. Optionally, the inner wall of the accommodation cavity 1231 is arranged itself in a circular shape.

Figure 5:
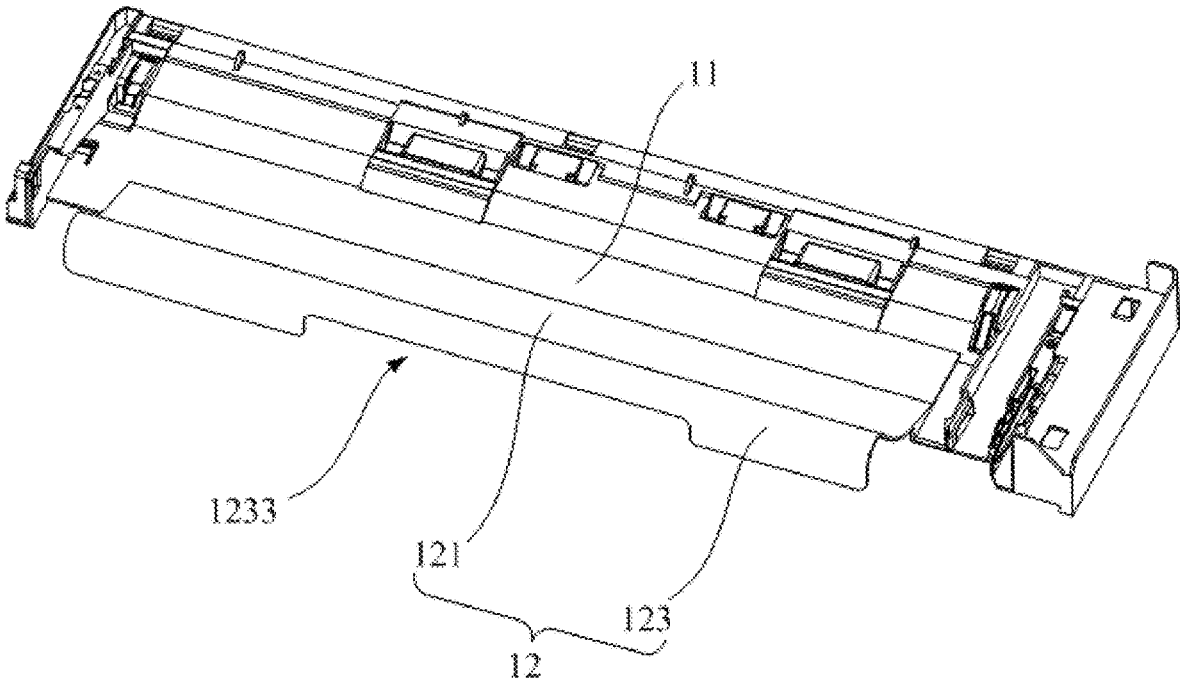
FIG. 5 is a schematic structural diagram showing an assembly of a chassis and an elastic plate of the air conditioner indoor unit.
Figure 6:
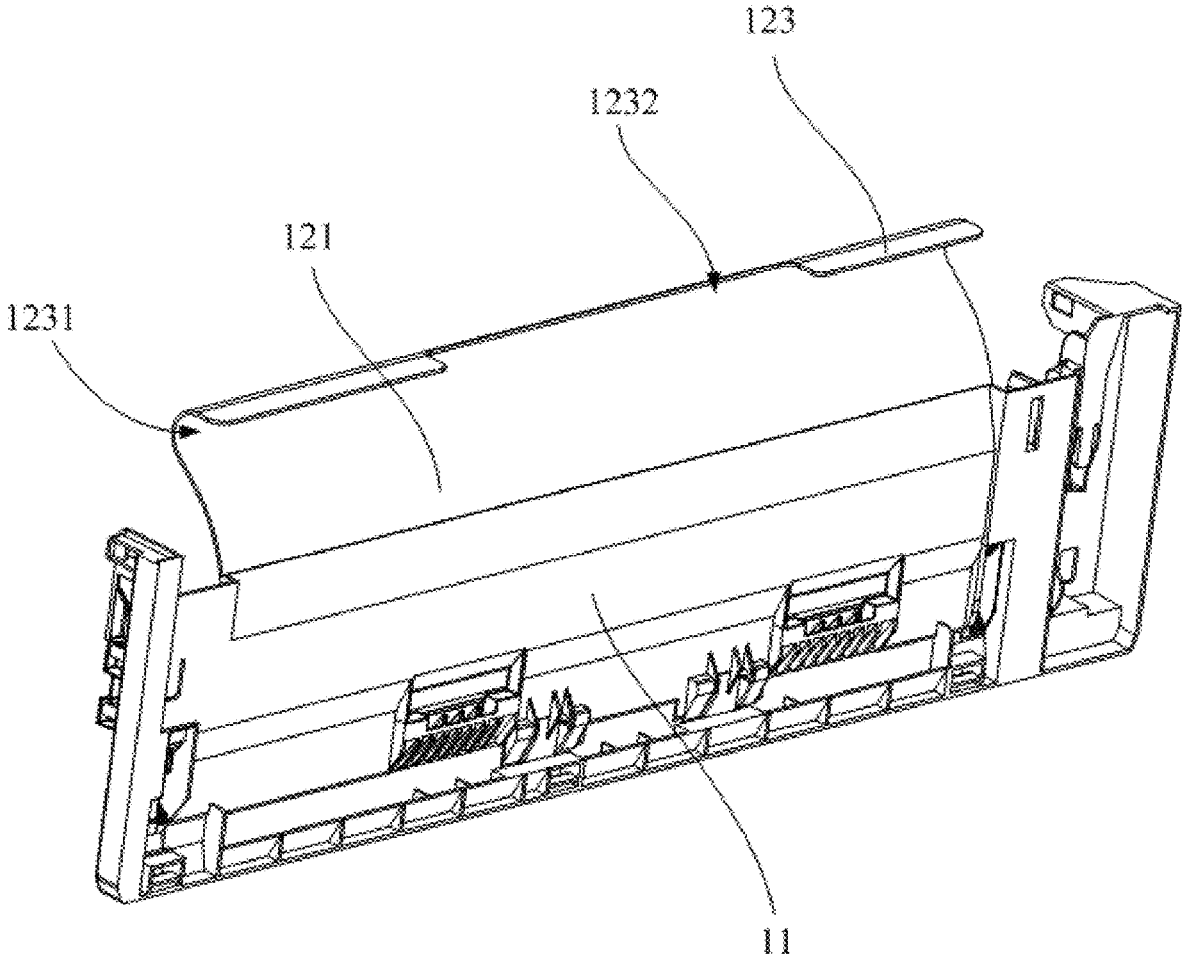
FIG. 6 is a schematic structural schematic diagram showing the assembly of the chassis and the elastic plate from another perspective.

Referring to FIGS. 1, 5 and 6, an installation notch 1233 is formed at the side of the partitioning member 123 facing away from the connection member 121, to expose the pipe joint of the pipe assembly 50. The installation notch 1233 is formed at the lower edge of the partitioning member 123, and the pipe joint of the pipe assembly 50 is exposed due to the installation notch 1233. When installing the pipe of the pipe assembly 50, a human hand can pass through the installation notch 1233 to perform the pipe connection, which is convenient to operate. In the meanwhile, the manufacturing cost of the elastic plate 12 is further reduced to a certain extent.

In at least one embodiment of the present disclosure, the elastic plate 12 and the chassis 11 are of an integral structure. Typically, the two are injection molded into an integral structure through a mold, and the integral structure can effectively enhance the strength of the elastic plate 12. Similarly, the connection member 121 and the partitioning member 123 in the elastic plate 12 are of an integral structure, so that the strength of the connection member 121 and the partitioning member 123 can be enhanced, thereby enhancing the overall strength of the elastic plate 12, further effectively preventing the elastic plate 12 from breaking due to elastic deformation, and improving the structural reliability of the air conditioner indoor unit 100.

In at least one embodiment of the present disclosure, the elastic plate 12 and the chassis 11 smoothly transit at the joint therebetween. When the elastic plate 12 is provided, the connection between the elastic plate 12 and the lower edge of the chassis 11 is set to be a smooth transition to further enhance the strength of the elastic plate 12, thereby more effectively preventing the elastic plate 12 from breaking due to elastic deformation and improving the structural reliability of the air conditioner indoor unit 100.

In at least one embodiment of the present disclosure, a plurality of elastic plates 12 are provided, the plurality of elastic plates 12 are arranged at intervals along the length direction of the chassis 11, and the air duct structure 20 is elastically abutted against at least one elastic plate 12 when being pulled out or pushed in. The lower edge of the chassis 11 is provided with a plurality of elastic plates 12 which are distributed at intervals along the length direction of the chassis 11, so that when the air duct structure 20 is pulled or pushed in, the air duct structure 20 can be elastically abutted against at least one elastic plate 12, and the at least one elastic plate 12 is deformed and swung toward the pipe assembly 50 to allow a space for the air duct structure 20 to pass through. Additionally, the manufacturing cost of the elastic plate 12 can be saved. In some embodiments, the plurality of elastic plates 12 are uniformly distributed along the length direction of the chassis 11, and the air duct structure 20 is elastically abutted against each elastic plate 12 when pulled out or pushed in, so that the pressing force on the elastic plate 12 is distributed to the plurality of elastic plates 12, and the force borne by each elastic plate 12 is relatively small. This effectively prevents the elastic plate 12 from breaking due to elastic deformation, and the structural reliability of the air conditioner indoor unit 100 can be improved. In addition, due to the gap between the two adjacent elastic plates 12, the pipe joint of the pipe assembly 50 can be exposed in the gap, so that the partitioning member 123 of the elastic plate 12 does not need to be provided with an installation notch 1233, thus simplifying the manufacturing process of the elastic plate 12 and improving its manufacturing efficiency.

In some embodiments, the plurality of elastic plates 12 and the chassis 11 are of an integral structure to ensure the strength of each elastic plate 12, thereby effectively preventing the elastic plate 12 from breaking due to elastic deformation and improving the structural reliability of the air conditioner indoor unit 100.

In one embodiment of the present disclosure, one elastic plate 12 is provided, which is located at the middle of the chassis 11 in the length direction, and the air duct structure 20 is elastically abutted against the elastic plate 12 when being pulled out or pushed in. One elastic plate 12 is arranged at the lower edge of the chassis 11 and is arranged at the middle part of the lower edge of the chassis 11. When the air duct structure 20 is pulled or pushed in, the elastic plate 12 only needs to elastically abut against the elastic plate 12, and the elastic plate 12 can be deformed and swung towards the pipe assembly 50 to allow a space for the air duct structure 20 to pass through, so as to ensure that the air duct structure 20 is smoothly pulled or pushed in. Additionally, the arrangement of one elastic plate 12 can also save the manufacturing cost.

In at least one embodiment of the present disclosure, two elastic plates 12 are provided, which are located at two ends of the chassis 11 in the length direction, and the air duct structure 20 is elastically abutted against at least one of the elastic plates 12 when being pulled out or pushed in. Two elastic plates 12 are respectively arranged at two ends of the lower edge of the chassis 11. When the air duct structure 20 is pulled or pushed in, the air duct structure 20 only needs to elastically abut against at least one elastic plate 12. The elastic plate 12 can be deformed and swung towards the pipe assembly 50 to allow the space for the air duct structure 20 to pass through, so as to ensure that the air duct structure 20 is smoothly pulled or pushed in. Similarly, the pipe connector of the pipe assembly 50 can be exposed at the gap between the two elastic plates 12, so that the partitioning member 123 of the elastic plate 12 does not need to be provided with an installation notch 1233, simplifying the manufacturing process of the elastic plate 12, and thus improving its manufacturing efficiency.

Referring again to FIGS. 1, 3, and 4, the housing 10 further includes a face frame 13 and a lower panel 14. The upper edge of the chassis 11 is connected to the face frame 13, and the face frame 13, the chassis 11, and the elastic plate 12 enclose to form the accommodation cavity 10*a*. The lower panel 14 is detachably mounted to the face frame 13 and is provided with an air outlet 141.

In some embodiments, the face frame 13, the chassis 11 and the elastic plate 12 enclose to form an accommodation cavity 10*a*; the heat exchanger 30 is installed at the upper part of the accommodation cavity 10*a*; the air duct structure 20 is installed at the lower of the accommodation cavity 10*a*; the lower panel 14 is detachably connected to the lower part of the face frame 13 and covers the air outlet side 20*b* at the lower part of the air duct structure 20, and the lower panel 14 is provided with an air outlet 141 for air to flow, so that air flowing out of the air outlet 23 at the lower part of the air duct structure 20 flows into the room through the avoiding hole to adjust indoor temperature. When the air duct structure 20 is to be removed, the lower panel 14 is first removed. The lower panel 14 can effectively prevent dust or sundries from falling into the interior of the air-conditioning indoor unit 100, thereby protecting components in the air-conditioning indoor unit 100 to a certain extent.

Referring again to FIG. 1, the back of the housing 10 is also provided with a wall-mount plate 15, and the side of the wall-mount plate 15 facing away from the housing 10 is provided with a hanging fastener 151. When installing air conditioner indoor unit 100, the wall mounted plate 15 is tightly attached to the wall surface, and the hanging fastener 151 on the wall mounted plate 15 is clamped and matched with the corresponding piece on the wall surface, so that the air conditioner indoor unit 100 can be integrally mounted, and the installation is simple and convenient.

The present disclosure further provides an air conditioner, which includes an air conditioner indoor unit 100 and an air conditioner outdoor unit connected with the air conditioner indoor unit 100. For the structure of the air conditioner indoor unit 100, reference can be made to the aforementioned embodiments. As the air conditioner takes all the technical solutions of the above embodiments, it has at least all the significance and effects brought by the technical solution of the above embodiments, and will not be described in detail here.

The above description refers to only optional embodiments of the present disclosure, and does not limit the scope of the present disclosure, and any transformation of equivalent structure made under the concept of the present disclosure by using the contents of this specification and the drawings, or direct/indirect application in other relevant technical fields, shall be included in the scope of the present disclosure.

What is claimed is:

1. An air conditioner indoor unit, comprising:

a housing having an accommodation cavity with an opening and including an elastic plate arranged at the opening; and an air duct structure detachably disposed in the accommodation cavity and configured to abut against and deform the elastic plate when passing through the opening.

2. The indoor unit according to claim 1, wherein:

the housing further includes a chassis; and the elastic plate is connected to an edge of the chassis.

3. The indoor unit according to claim 2, further comprising:

a pipe assembly;

wherein:

the elastic plate includes:

a partitioning member positioned between the pipe assembly and the air duct structure; and a connection member, one side of the connection member being connected to the partitioning member, and another side of the connection member away from the partitioning member being connected to the edge of the chassis; and the air duct structure is configured to abut against at least one of the connection member or the partitioning member when passing through the opening.

4. The indoor unit according to claim 3, wherein the partitioning member is bent towards the pipe assembly.

5. The indoor unit according to claim 3, wherein the partitioning member includes a receiving cavity facing towards the pipe assembly and the pipe assembly is received in the receiving cavity.

6. The indoor unit according to claim 5, wherein an inner wall of the receiving cavity has an arc shape.

7. The indoor unit according to claim 3, wherein the partitioning member includes an installation notch at a side of the partitioning member away from the connection member, the installation notch exposing a pipe joint of the pipe assembly.

8. The indoor unit according to claim 3, further comprising:

a heat exchanger disposed in the accommodation cavity and connected with the pipe assembly.

9. The indoor unit according to claim 3, further comprising:

a wall-mount plate disposed at a back of the housing; and a hanging fastener at a side of the a wall-mount plate away from the housing.

10. The indoor unit according to claim 2, wherein the elastic plate and the chassis are of an integral structure.

11. The indoor unit according to claim 2, wherein the elastic plate and the chassis are connected with a smooth joint.

12. The indoor unit according to claim 2, wherein the elastic plate is disposed at a middle of the chassis in a length direction of the chassis.

13. The indoor unit according to claim 2, wherein:

the elastic plate is one of two elastic plates of the housing, the two elastic plates being disposed at two ends of the chassis in a length direction of the chassis, respectively; and the air duct structure is configured to abut against at least one of the two elastic plates when passing through the opening.

14. The indoor unit according to claim 2, wherein:

the elastic plate is one of a plurality of elastic plates of the housing, the plurality of elastic plates being disposed at intervals along a length direction of the chassis; and the air duct structure is configured to abut against at least one of the plurality of elastic plates when passing through the opening.

15. The indoor unit according to claim 2, wherein the housing further includes a face frame connected to another edge of the chassis.

16. The indoor unit according to claim 15, wherein the face frame, the chassis, and the elastic plate enclose to form the accommodation cavity.

17. The indoor unit according to claim 15, wherein the housing further includes a lower panel detachably mounted at the face frame and including an air outlet.

18. The indoor unit according to claim 2, further comprising:

a wall-mount plate disposed at a back of the housing; and a hanging fastener at a side of the a wall-mount plate away from the housing.

19. The indoor unit according to claim 1, further comprising:

a wall-mount plate disposed at a back of the housing; and a hanging fastener at a side of the a wall-mount plate away from the housing.

20. An air conditioner, comprising:

an outdoor unit; and an indoor unit connected to the outdoor unit and including:

a housing having an accommodating cavity with an opening and including an elastic plate arranged at the opening; and an air duct structure detachably disposed in the accommodating cavity and configured to abut against and deform the elastic plate when passing through the opening.

* * * * *